US006971377B2

(12) United States Patent
Moyer et al.

(10) Patent No.: US 6,971,377 B2
(45) Date of Patent: Dec. 6, 2005

(54) EXHAUST GAS RECIRCULATION COOLER WITH BYPASS FLOW

(75) Inventors: Michael A. Moyer, Lomita, CA (US); Glenn F. Thompson, Palos Verdes Estates, CA (US); Roland Dilley, Lomita, CA (US); Kristian Dullack, Carson, CA (US); Sara Chastain, Hermosa Beach, CA (US); Freidoon Rastegar, Rancho Palos Verdes, CA (US)

(73) Assignee: Honeywell International, Inc., Morristown, NJ (US)

( * ) Notice: Subject to any disclaimer, the term of this patent is extended or adjusted under 35 U.S.C. 154(b) by 151 days.

(21) Appl. No.: 10/414,351

(22) Filed: Apr. 15, 2003

(65) Prior Publication Data

US 2004/0206342 A1 Oct. 21, 2004

(51) Int. Cl.[7] ..... F02M 25/07
(52) U.S. Cl. ..... 123/568.12; 165/51
(58) Field of Search ..... 165/51, 52; 123/568.12; 60/288, 287, 298, 320, 274, 605.2

(56) References Cited

U.S. PATENT DOCUMENTS 6,141,961 A * 11/2000 Rinckel ..... 60/320
2003/0150434 A1 * 8/2003 Leedham et al. ..... 123/568.12
2004/0107949 A1 * 6/2004 Miyoshi et al. ..... 123/568.12

* cited by examiner

*Primary Examiner*—Henry C. Yuen
*Assistant Examiner*—Arnold Castro
(74) *Attorney, Agent, or Firm*—Ephraim Starr; Chris James

(57) ABSTRACT

An EGR cooler comprises a cooling core having a plurality of passages for accommodating the flow of exhaust gas therethrough, an exhaust gas inlet chamber connected to the cooling core, for receiving exhaust gas from an internal combustion engine and passing the exhaust gas to the cooling core, and an exhaust gas outlet chamber separate from the exhaust gas inlet chamber and connected to the cooling core for receiving exhaust gas from the core. The cooler further includes means for permitting the controlled passage of exhaust gas from the exhaust gas inlet chamber to the exhaust gas outlet chamber without passing through the cooling core, said means being positioned upstream from the exhaust gas outlet chamber. Configured in this manner, the EGR cooler permits the mixing of cooled exhaust gas with uncooled exhaust to provide a desired exiting gas temperature that is below an exhaust gas dew point.

4 Claims, 5 Drawing Sheets

EXHAUST GAS RECIRCULATION COOLER WITH BYPASS FLOW

FIELD OF THE INVENTION

This invention relates generally to the field of gasoline and diesel-powered internal combustion engines that make use of exhaust gas recirculation (EGR) systems for emissions improvement and, more particularly, to an improved EGR cooler used in such system to provide a more controlled exiting exhaust gas temperature.

BACKGROUND OF THE INVENTION

EGR is a known method for reducing $NO_x$ emissions in internal combustion engines. Conventional EGR systems work by taking a by-pass stream of engine exhaust gas from an engine exhaust manifold directing the same to an EGR valve. The EGR valve is designed and operated to provide a desired amount of exhaust gas for mixture with intake air and injection into the engine's induction system for subsequent combustion. The EGR valve regulates the amount of exhaust gas that is routed to the engine induction system based on engine demand.

The process of recirculating the exhaust gas insures that partially oxidized $NO_x$ become fully oxidized, thereby reducing smog producing partially-oxidized $NO_x$ emissions. Accordingly, such a conventional EGR system typically comprises exhaust by-pass tubing, related plumbing and manifolding, an engine crankshaft-driven EGR pump (if further pressurizing is necessary), and an EGR control valve, all of which are ancillary components that are attached to the engine.

In certain applications, is it desired that the exhaust gas exiting the EGR system and being introduced into the engine intake system for combustion be cooled for the purposes of reducing emissions, specifically $NO_x$. Accordingly, it is known that a cooler is used in certain EGR systems for the purpose of cooling or reducing the temperature of the exhaust gas that is passed through the EGR valve to the engine intake system. Typically, the EGR cooler is placed downstream from the EGR valve outlet such that all exhaust gas existing the valve for directing to the engine intake is routed through the cooler. Such EGR coolers can be air or water cooled, and can be configured having single or multiple passes, as required for the particular application.

A suspected issue, however, with the use of such conventional EGR coolers is that under certain operating conditions the exhaust gas passing through the cooler from the EGR valve can be cooled, i.e., reduced in temperature, to a point that is below the dew point of the exhaust gas. When this occurs, condensation is known to form in the exhaust gas stream exiting the EGR cooler and that is directed to the engine intake system. The presence of such condensation during the exhaust gas cooling process is not desired because the condensate is known to mix with the exhaust gas to form acidic materials, e.g., $HNO_3$. The presence of such acidic materials can possibly harm downstream components of the engine intake system, which could adversely impact engine service life.

It is, therefore, desired that an EGR cooling system/cooler be configured in a manner that can help reduce the occurrence and production of condensation in the exiting exhaust gas stream. It is desired that such EGR cooler be relatively easy to implement and not take up excessive space in the engine compartment. It is further desired that such EGR cooler system be configured in a manner capable of being operated with the EGR valve to provide EGR to an engine without unnecessary complexity.

SUMMARY OF THE INVENTION

EGR coolers of this invention generally comprise a cooling core having a plurality of passages for accommodating the flow of exhaust gas therethrough. The cooling core is in contact with a desired cooling medium to effect a desired reduction of the exhaust gas temperature as it is passed through the cooling core.

The cooler includes an exhaust gas inlet chamber connected to the cooling core for receiving exhaust gas from an internal combustion engine and passing the exhaust gas to the cooling core, and an exhaust gas outlet chamber separate from the exhaust gas inlet chamber and connected to the cooling core for receiving exhaust gas therefrom.

The cooler further includes means for permitting the controlled passage of exhaust gas from the exhaust gas inlet chamber to the exhaust gas outlet chamber without passing through the cooling core, said means being positioned upstream from the exhaust gas outlet chamber.

EGR coolers of this invention can be provided in the form of a single-pass design, whereby the exhaust gas inlet and outlet chamber are positioned at different sides of the cooling core and the exhaust gas passes through the core a single time. In such single-pass design, the EGR cooler includes a bypass exhaust passage, extending between the exhaust gas inlet and outlet chambers, that bypasses the cooling core, and a bypass exhaust port with a valve assembly, to permit the controlled passage of exhaust gas from the exhaust gas inlet chamber, through the bypass exhaust passage, and to the exhaust gas outlet chamber.

EGR coolers of this invention can also be provided in the form of a multi-pass design, wherein the exhaust gas inlet and outlet chamber are positioned on the same side of the cooling core and the exhaust gas passes through the core more than one time. In such multi-pass design, the EGR cooler exhaust gas inlet and outlet chambers can be separated by a wall structure, and a bypass exhaust gas port is disposed through the wall structure. A valve assembly is used in conjunction with the bypass exhaust gas port to permit the controlled passage of exhaust gas from the exhaust gas inlet chamber to the exhaust gas outlet chamber in a manner bypassing the cooling core.

Configured in this manner, EGR coolers of this invention permit mixing of cooled exhaust gas with uncooled exhaust gas, provided directly to the exhaust gas outlet chamber via the bypass exhaust port, to provide a desired exiting gas temperature that is below an exhaust gas dew point. This is desired as it operates to prevent the unwanted formation of condensate in the exhaust gas stream heading to the engine intake system.

DESCRIPTION OF THE DRAWINGS

The details and features of the present invention will be more clearly understood with respect to the detailed description and drawings in which.

DETAILED DESCRIPTION OF THE INVENTION

EGR coolers of invention are designed having a exhaust gas bypass port and bypass valve assembly connected thereto to provide an alternative flow path for exhaust gas, provided from an EGR valve, to avoid passage through a cooling core of the EGR cooler. This bypass exhaust gas flow is provided for the purpose of helping to control the outlet temperature of exhaust gas exiting the EGR cooler so that it is above an exhaust gas dew point, thereby helping to control the unwanted formation of condensation in the EGR cooler.

Figure 1:
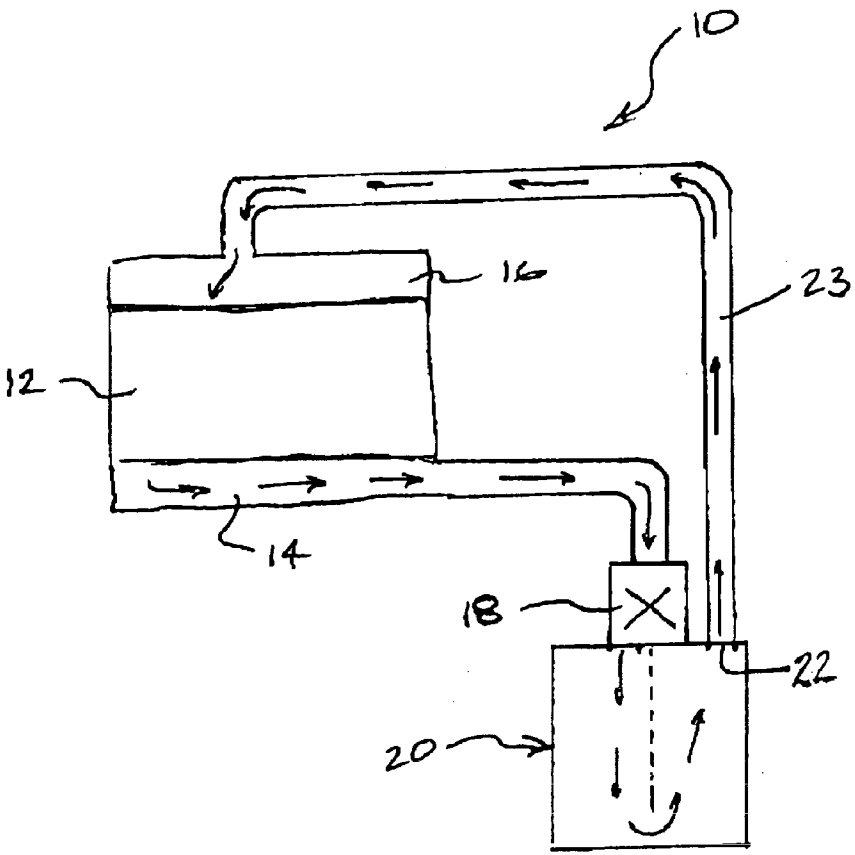
FIG. 1 PRIOR ART
FIG. 1 is schematic view of a conventional exhaust gas recirculation (EGR) system comprising a prior art EGR cooler.

FIG. 1 schematically illustrates a prior art EGR system 10 comprising an internal combustion engine 12, which can be either gasoline or diesel powered. The engine 12 includes an exhaust system manifold 14 attached thereto downstream of the engine's internal combustion chambers for removing exhaust gas from the engine, an intake system manifold 16 attached thereto upstream of the engine's internal combustion chambers for directing a desired combustion mixture to engine. The engine can also include a turbocharger, not shown, driven by the exhaust gas existing the engine via the exhaust manifold, and used to pressurize the combustion mixture entering the engine via the intake manifold. The engine can also include supercharger that is driven by the engine crankshaft to deliver pressurized air via the intake manifold to the engine for combustion.

An EGR control valve 18 is connected downstream of the exhaust manifold 14 to receive an exhaust gas stream from the engine. The EGR control valve 18 is configured to regulate a desired amount of exhaust gas flow for subsequent reintroduction into the engine intake system for combustion. The EGR valve 18 is connected to an EGR cooler 20 that receives exhaust gas exiting the EGR valve for passage therethrough for cooling the exhaust gas prior to reintroduction.

The EGR cooler 20 shown in this particular example is of a multi-pass (e.g., a two-pass) design, so that exhaust gas entering the cooler from the EGR valve 18 passes through the cooler twice. It is to be understood that EGR coolers useful with EGR systems can be of a single or multi-pass design. Cooled exhaust gas exits the cooler 20 via an outlet 22. The outlet 22 is coupled via a suitable connector 23 to the engine intake system 16 for mixing with intake air and routing to the combustion chamber.

Figure 2:
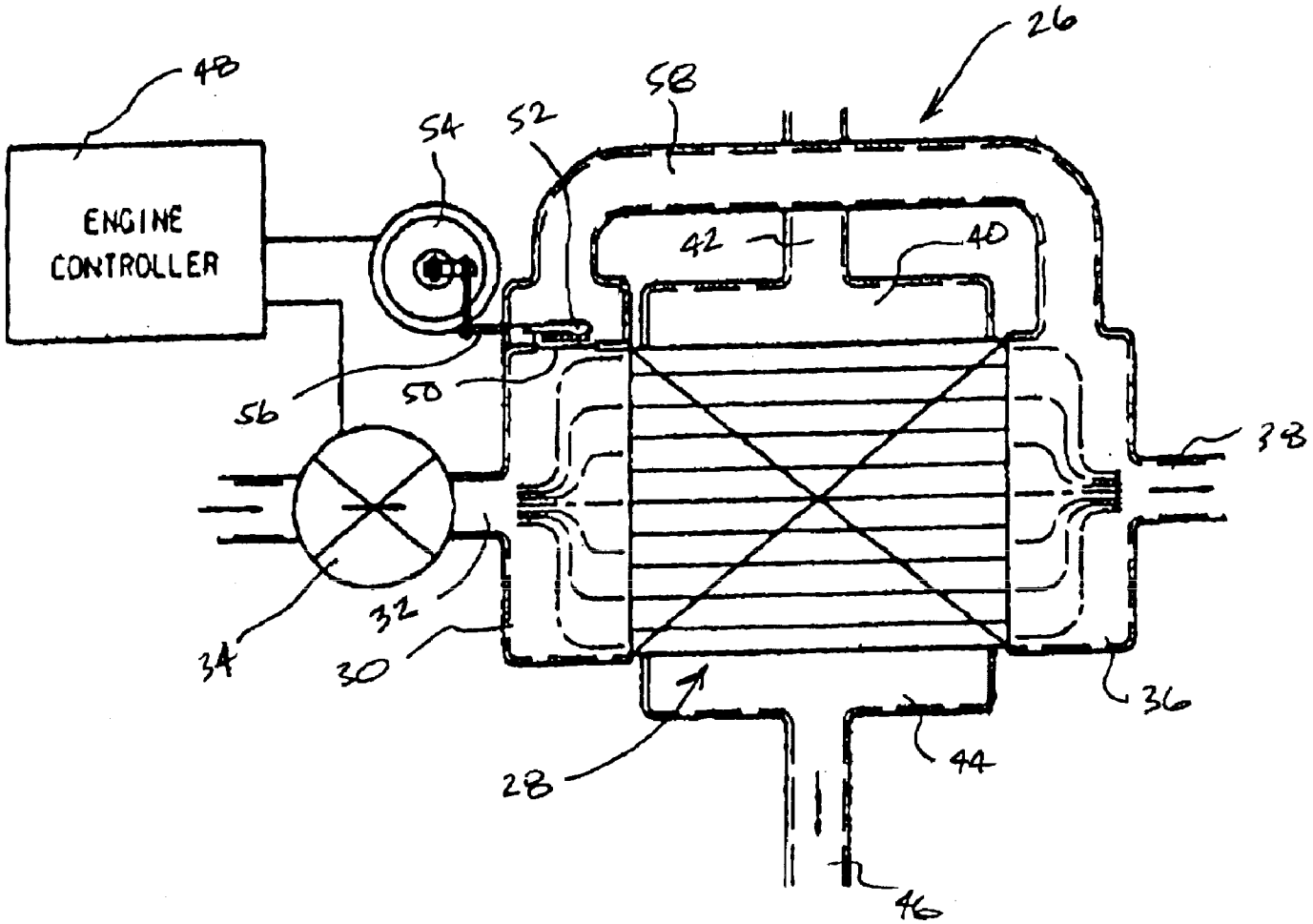
FIGS. 2 to 4 are schematic cross sectional side elevations of a first embodiment EGR cooler of this invention shown in three different operating conditions.

FIG. 2 illustrates a first embodiment EGR cooler 26 of this invention comprising a single-pass cooling core 28 that is configured having a number of internal passages that are adapted to accommodate the passage of exhaust gas therethrough. An exhaust gas inlet chamber, manifold or tank 30 is attached at one end of the core and is configured having an exhaust gas inlet opening 32 at one of its ends to receive exhaust gas from an exhaust gas control valve 34.

As mentioned above, the exhaust gas is provided to the exhaust gas control or EGR valve 34 from a pipe or suitable connection means in gas flow communication with the engine exhaust manifold. The exhaust gas inlet chamber 30 is configured internally to receive exhaust gas through its exhaust gas opening 32 and pass the same to an adjacent inlet portion of the core 28. An exhaust gas outlet chamber, manifold or tank 36 is attached to an end of the core 28 opposite the exhaust gas inlet chamber 30, and is configured internally to receive exhaust gas that has been passed through the core for passing through the cooler via an exhaust gas outlet opening 38.

The cooler 26 includes a coolant inlet tank 40 that is attached to an end of the core 28 intermediate the exhaust gas chambers 30 and 36. The coolant inlet tank 40 is configured to receive a desired coolant via a coolant inlet opening 42 and direct the same to the core for the purpose of conduction cooling the exhaust gas being passed therethrough. A coolant outlet tank 44 is attached to an end of the core 28 opposite from the coolant inlet tank 40, and is configured to receive coolant that has passed over the core for removal from the cooler via a coolant outlet opening 46.

Although an EGR cooler comprising a liquid cooling medium has been disclosed, it is to be understood that EGR coolers of this invention are intended to be used with a variety of commonly used cooling mediums that may or may not be liquids, e.g., which can be adapted for air cooling.

Configured in this general manner, exhaust gas existing an engine is passed into the cooler 26 via the EGR valve 34 that is operated by an engine controller 48. The exhaust gas existing the EGR valve is directed into the exhaust gas inlet chamber 30 where it is distributed and passed to the core 28. The exhaust gas passes through a plurality of internal passages within the core. A desired coolant is placed into contact with the core, via the coolant inlet and outlet tanks 26 and 44, for the purpose of reducing the temperature of the exhaust gas passing therethrough by conduction cooling. Cooled exhaust gas exits an opposite end of the core 28 and is collected within the exhaust gas outlet chamber 36 for removal from the cooler.

EGR coolers 26 of this invention additionally comprise an exhaust gas bypass feature that enables a desired amount of exhaust gas to bypass the cooling core. In an example embodiment, the exhaust gas bypass feature is embodied in the form of an exhaust gas bypass port 50 disposed within a portion of the exhaust gas inlet chamber 30, and a exhaust gas bypass valve 52 positioned adjacent the bypass port 50 to both prevent passage of exhaust gas therefrom in a "closed" position, and permit passage of exhaust gas therethrough in an "opened" position.

The type of bypass valve 52 used in this capacity can be of any conventional design, e.g., a flapper valve, butterfly valve, slide valve, poppet valve, and the like. The bypass valve 52 is controlled by a suitable actuator 54, which can be of an electronic, mechanical, hydraulic or pneumatic design. The actuator 54 is controlled by the engine controller 48, and a suitable valve linkage assembly 56 is used to connect the actuator to the valve.

The exhaust gas bypass feature of this EGR cooler is further provided by the use of a bypass passage or conduit 58 that is configured to permit the passage of exhaust gas from the exhaust gas bypass port 50 to the exhaust gas outlet chamber 36 when the exhaust gas bypass valve 52 is operated in an opened position. In an example embodiment, the bypass passage 58 is in the form of a pipe or conduit that bypasses the core 28 and that facilitates uncooled passage of the exhaust gas from the exhaust gas inlet chamber 30 to the exhaust gas outlet chamber 36.

The EGR cooler 26 provided in FIG. 2 illustrates the cooler in an operating position to receive exhaust gas from the open EGR valve 34. However, the exhaust gas bypass feature of the cooler is closed, with the bypass valve 52 positioned to seal off the exhaust gas bypass port 50, thereby providing a full degree of exhaust gas cooling via 100 percent passage of exhaust gas through the cooling core 28.

Figure 3:
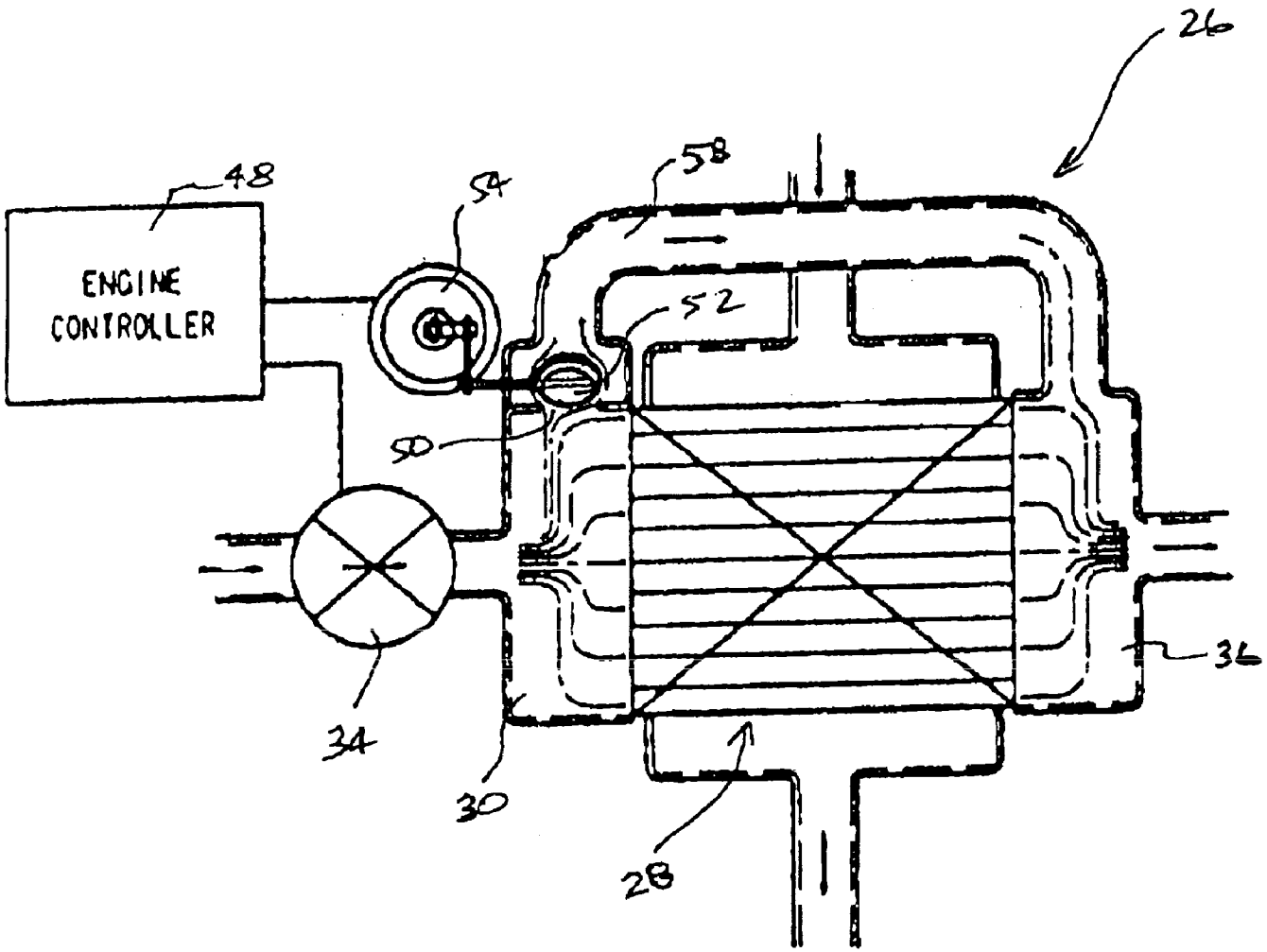

FIG. 3 illustrates the same EGR cooler as described above and illustrated in FIG. 2, except for the fact that the cooler exhaust bypass feature is enabled or operated in an open position. Specifically, exhaust gas is directed into the cooler 26 via an opened EGR valve 34. The bypass exhaust gas valve 52 is moved away from the exhaust gas bypass port 50, by operation of the valve actuator 54, to cause a desired stream of exhaust gas to leave the exhaust gas inlet chamber 30 and bypass the cooler 28. The exhaust gas existing the inlet exhaust gas chamber 30 is passed into the bypass passage 58 for delivery of uncooled exhaust gas into the exhaust gas outlet chamber 36.

In an example embodiment, the amount of exhaust gas routed through the bypass passage 58 is that amount determined to be necessary to combine with the cooled exhaust gas exiting the core 28 to increase the gas temperature within the exhaust gas outlet chamber 36 in an amount necessary to avoid unwanted condensation. In such example embodiment, this function can be performed by the engine controller 48.

Figure 4:
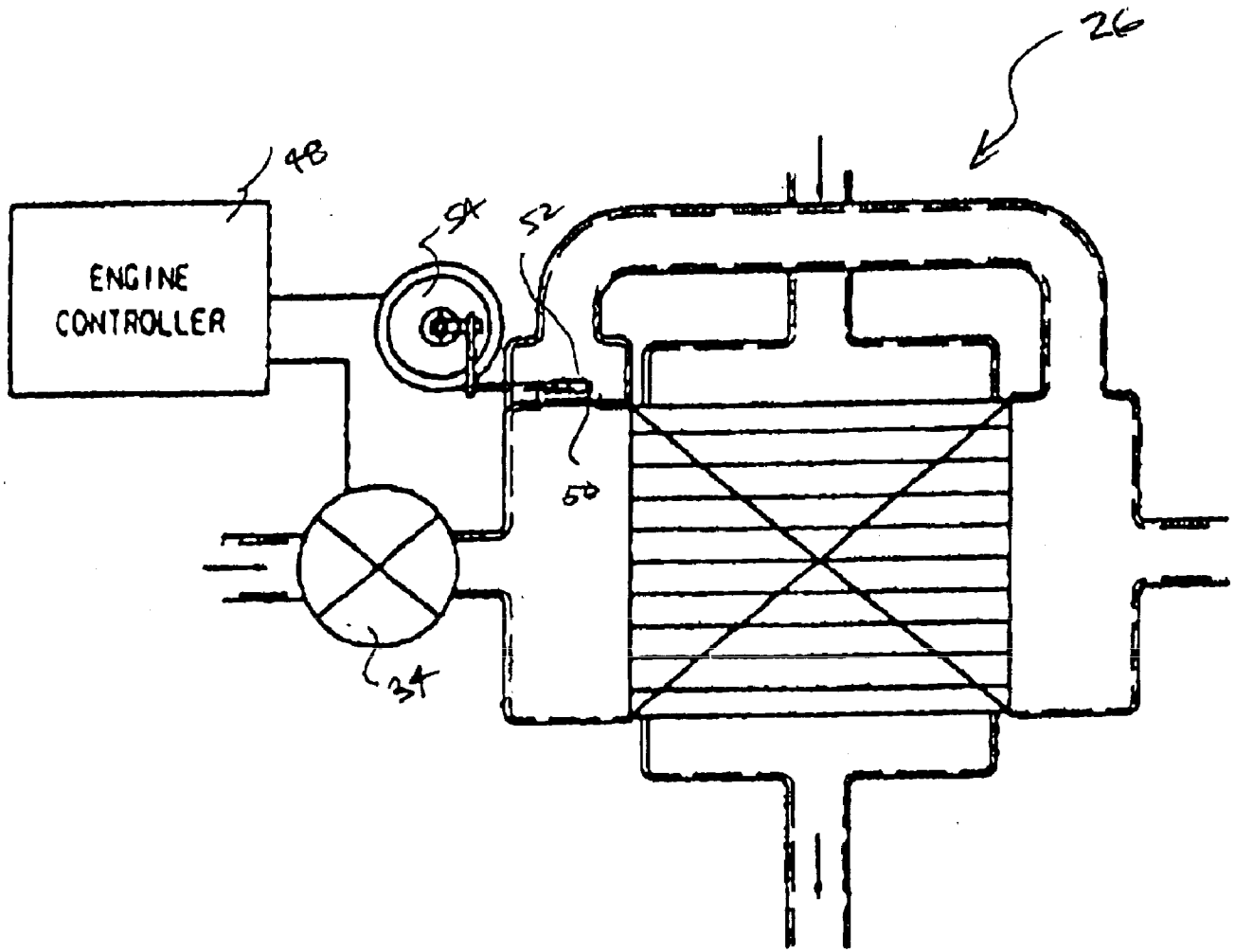

FIG. 4 illustrates the same EGR cooler as described above and illustrated in FIGS. 2 and 3, except for the fact that both the EGR valve and the cooler exhaust bypass feature are operated in the closed position. Specifically, exhaust gas existing the engine is prevented from entering the cooler 26 via a closed EGR valve 34. The EGR valve is placed into the close position by the engine controller 48. In this operating mode, the bypass exhaust gas valve 52 can also be placed into a closed position against the exhaust gas bypass port 50, by operation of the valve actuator 54.

Although the EGR coolers described above and illustrated in FIGS. 2 to 4 are of a single pass design, it is to be understood that EGR coolers of this invention having bypass exhaust gas flow capacity can also be provided in the form of a multi-pass design or type.

Figure 5:
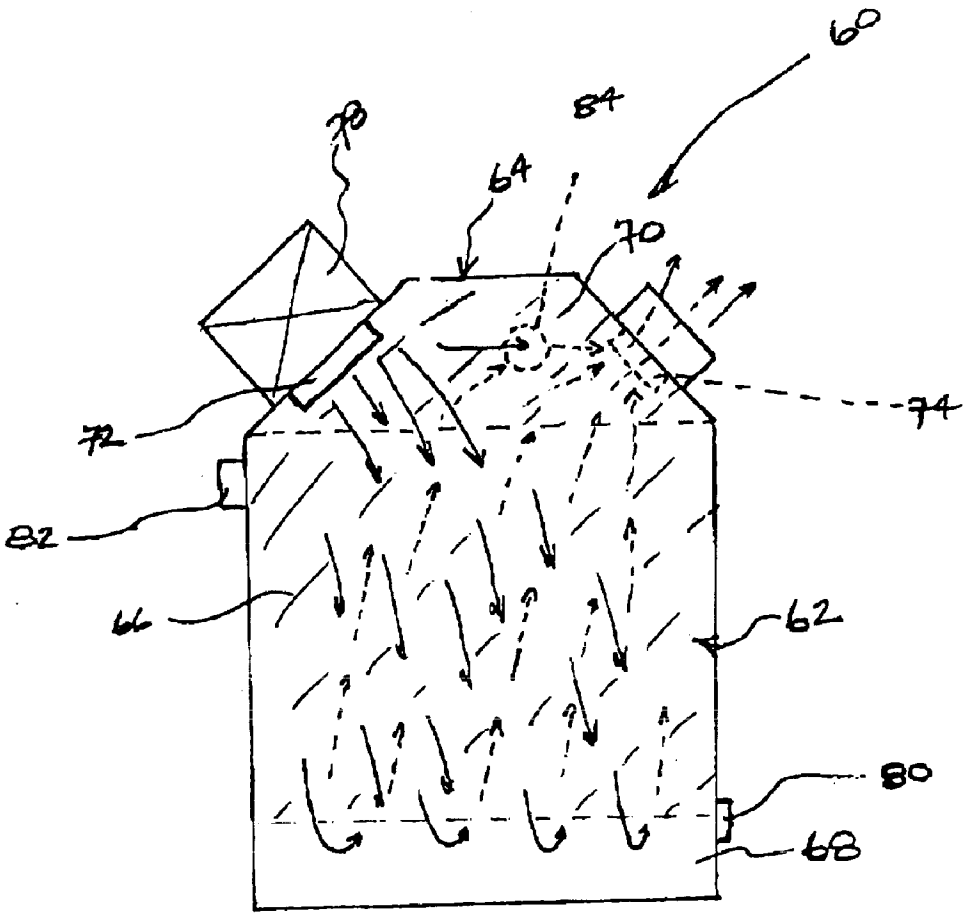
FIG. 5 is a schematic cross-sectional side elevation of a second embodiment EGR cooler of this invention.

FIG. 5 illustrates a second embodiment EGR cooler 60 of this invention comprising a cooler housing or core 62 having a top portion or tank 64 attached to an upper portion of the housing. The core 62 is of a two-pass design and includes means 66 for defining the two exhaust gas flow passages. Such means can be, for example, in the form of a partition or other equivalent structure. In FIG. 5, the partition 66 is positioned parallel with the plane of the drawing so that a first exhaust gas passage is defined in front of the partition, and a second exhaust gas passage is defined behind the partition. A gap 68 is provided at the bottom of the core between the partition and the housing to enable gas passage from the first to the second exhaust gas passage.

The EGR cooler top tank 64 also includes a partition 70 positioned therein, that can be integral or separate from the housing partition 66, that functions to define two separate tank chambers; namely, an exhaust gas inlet chamber and an exhaust gas outlet chamber. The top tank can be formed from a single part having a partition included therein for forming separate tank chambers, or can be formed from two or more separate parts that independently define the tank chambers.

The top tank 64 includes an exhaust gas inlet 72 disposed therethrough at one side of the partition 70 that empties into the inlet chamber, and an exhaust gas outlet 74 disposed therethrough at an opposite side of the partition that is in gas flow communication with the outlet chamber. An EGR control valve 78 is connected to the top tank exhaust gas inlet 72 and is controlled by conventional means, e.g., by an engine controller, to direct a desired amount of exhaust gas through the EGR cooler for cooling and ultimate delivery to the engine intake system.

Thus, configured in this manner, exhaust gas exiting the EGR valve 78 enters the cooler 60 via the top tank inlet 72 and is passed downwardly through the first cooling passage in the core 62 until it reaches near the core bottom where the petition gap 68 permits the upwardly passage of exhaust gas along the second cooling passage towards the top tank where the gas is allowed to exit the cooler via the outlet 74.

The EGR coolers of this invention can be air cooler or liquid cooled depending on the particular application. In an example embodiment, the cooler is liquid cooled and comprises a series of internal passages within the cooling core that operate to physically isolate the liquid from the exhaust gas but that serve to cool the exhaust gas by conduction heat transfer, i.e., by of the exhaust gas against the liquid cooling passages. Accordingly, the cooler 62 includes one or more liquid inlets 80, and one or more liquid outlets 82 to facilitate liquid passage through the cooler for conduction cooling.

As with the first embodiment EGR cooler described above, the second embodiment EGR cooler 60 includes a bypass port or opening 84 in the top tank 64 through the partition 70, or other comparable structural member separating the inlet and outlet exhaust gas chambers. The bypass port 84 is sized and configured to permit passage of exhaust gas from the inlet exhaust gas chamber to the outlet exhaust gas chamber prior to the gas being routed through the cooler.

A valve assembly (not shown in FIG. 2) is connected to the cooler and is used to regulate the passage of exhaust gas through the bypass port 84 as desired to provide a desired combination of cooled and uncooled exhaust gas to provide a cooler exhaust gas outlet temperature that prevents unwanted condensation. The valve assembly comprises the same type of valve, actuator, and actuator assembly discussed above with reference to the first EGR cooler embodiment.

The members used to constructed EGR coolers of this invention are formed from materials conventionally used to form heat exchangers, e.g., metallic materials, and are connected together by conventional connection methods, e.g., by bolted connection or by brazing or welding.

EGR coolers of this invention are specifically constructed to permit the desired passage of uncooled exhaust gas to mix with cooler exhaust gas for the purpose of controlling the exhaust gas outlet temperature. The EGR cooler bypass valve assembly is actuated in a manner that controls the amount of bypass exhaust gas necessary to control the exiting EGR cooler exhaust gas temperature so as to avoid or control unwanted condensation, thereby eliminating the production of potentially harmful acid materials that may otherwise enter the engine intake system. Accordingly, EGR coolers of this invention are designed to protect the engine from such unwanted acid materials, thereby operating to extend engine service life.

Having now described the invention in detail as required by the patent statutes, those skilled in the art will recognize modifications and substitutions to the specific embodiments disclosed herein. Such modifications are within the scope and intent of the present invention.

What is claimed is:

1. An exhaust gas recirculation cooler comprising:

a cooling core comprising a plurality of passages for accommodating the flow of exhaust gas therethrough;

an exhaust gas inlet chamber connected to the cooling core for receiving exhaust gas from an internal combustion engine and passing the exhaust gas to the cooling core;

an exhaust gas outlet chamber separate from the exhaust gas inlet chamber and connected to the cooling core for receiving exhaust gas from the core; and means connected to the exhaust gas inlet chamber for permitting the controlled passage of exhaust gas from the exhaust gas inlet chamber to the exhaust gas outlet chamber without passing through the cooling core wherein the means comprises an exhaust gas bypass port disposed through a portion of the exhaust gas inlet chamber and a valve assembly connected to the cooler and having a valve member disposed adjacent the exhaust gas bypass part to regulate exhaust gas flow therethrough, wherein the exhaust gas inlet chamber and exhaust gas outlet chamber are on the same side of the cooling core and are separated from one another by a partition, and wherein the exhaust gas bypass port is disposed through the partition to permit the passage of uncooled exhaust gas from the exhaust gas inlet chamber to the exhaust gas outlet chamber.

2. The cooler as recited in claim 1 further comprising means connected to the cooling core for reducing the temperature of the exhaust gas passing therethrough from the exhaust gas inlet chamber to the exhaust gas outlet chamber.

3. An exhaust gas recirculation cooler comprising:

a cooling core comprising a plurality of passages for accommodating the flow of exhaust gas therethrough;

an exhaust gas inlet chamber connected to one side of the cooling core for receiving exhaust gas from an internal combustion engine and passing the exhaust gas to the cooling core;

an exhaust gas outlet chamber connected to the same side of the cooling core fur receiving cooled exhaust gas from the cooling core, wherein the exhaust gas inlet chamber and outlet chamber arm separated from one another by a wall structure; and means connected to the cooler for permitting the controlled passage of exhaust gas from exhaust gas inlet chamber to the exhaust gas outlet chamber in a manner bypassing the cooling core.

4. The cooler as recited in claim 3 wherein the means for permitting comprises:

an exhaust gas port disposed through the wall structure; and a valve assembly connected to the cooler and having a valve member disposed adjacent the exhaust gas port to regulate exhaust gas flow therethrough.

* * * * *